United States Patent [19]

Müller et al.

[11] Patent Number: 4,687,341

[45] Date of Patent: Aug. 18, 1987

[54] TIMER

[75] Inventors: Jacques Müller, Reconvilier; Alexandre Cassani, Lausanne, both of Switzerland

[73] Assignee: ETA SA Fabriques d'Ebauches, Granges, Switzerland

[21] Appl. No.: 855,646

[22] Filed: Apr. 25, 1986

[30] Foreign Application Priority Data

Apr. 30, 1985 [CH] Switzerland ..... 1827/85

[51] Int. Cl.[4] ..... G04F 8/00; G04B 19/06

[52] U.S. Cl. ..... 368/109; 368/233

[58] Field of Search ..... 368/107–108, 368/69–74, 185–188; 340/347 P

[56] References Cited

U.S. PATENT DOCUMENTS

| | | | |
|---|---|---|---|
| 3,930,142 | 12/1975 | Meier | 235/92 EV |
| 3,988,885 | 11/1976 | Flumm et al. | 368/109 |
| 4,040,248 | 8/1977 | Laesser | 368/252 |
| 4,091,612 | 5/1978 | Meisner et al. | 368/155 |
| 4,196,583 | 4/1980 | Komaki | 368/251 |
| 4,232,510 | 11/1980 | Tamaru et al. | 368/28 |
| 4,253,177 | 2/1981 | Hafner | 368/187 |
| 4,266,288 | 5/1981 | Berney | 368/69 |
| 4,374,622 | 2/1983 | Kashio | 368/74 |
| 4,449,832 | 5/1984 | Kammerer | 368/187 |
| 4,490,051 | 12/1984 | Flaig et al. | 368/109 |
| 4,494,879 | 1/1985 | Meisner | 368/108 |

FOREIGN PATENT DOCUMENTS

| | | |
|---|---|---|
| 7832292 | 2/1979 | Fed. Rep. of Germany . |
| 2397764 | 2/1979 | France . |

*Primary Examiner*—Vit W. Miska

*Attorney, Agent, or Firm*—Sughrue, Mion, Zinn, Macpeak & Seas

[57] ABSTRACT

A timer advantageously in the form of a wristwatch and is combined with the time indicating function of the watch. The timer comprises a setting device enabling an accumulator to be loaded through the medium of a position transducer. The movement of the setting device being a stepwise one, each of its shifts enables a pulse to be generating which corresponds to a number of reference periods supplied by a time base. The accumulator is counted down by the time base and, when the accumulator is empty, a warning signal generating device is triggered.

27 Claims, 11 Drawing Figures

TIMER

FIELD OF THE INVENTION

The present invention relates to clock devices, also called timers, enabling the production of a warning signal to be caused after the expiry of an interval of time which can be set in advance.

DESCRIPTION OF THE PRIOR ART

Electromechanical timers are used at the present time in many applications, among which there may be mentioned kitchen timer which are integrated or not in cooking appliances, portable devices enabling the wearer to be reminded of a given time (the time of expiry of a parking meter, for example) and other similar applications.

All these timers comprise in general time base establishing a constant reference period, a device for setting the interval of time to be measured, in which the setting member is provided with a graduation calibrated in units of time, a device generating an alarm signal, and means for counting the number of reference periods contained in the said interval for commanding on its expiry the triggering of the said generating device.

In a known construction of this kind, the means for counting the number of reference periods are arranged in the following manner. The time base is a quartz resonator which, through the medium of a dividing circuit can command a stepping motor of horological type. This motor is coupled to the setting member which takes the form of a rotary disc and comprises a graduation calibrated in minutes, for example, and cooperating with a fixed reference mark. This disc is fast with a cam associated with an inverter and provided with a notch which corresponds to the zero position of the disc, the inverter being on in one direction for any position other than the zero position of the disc. This inverter is electrically connected in the circuit of the motor in such manner that as soon as the disc leaves the zero position it is set going to bring the disc back. Moreover, the generating device is actuated by the inverter in its other position when the notch of the disc is in front of it.

The disadvantage of this type of timer is that its precision is poor, because the angular position of the setting member which determines the duration of the interval to be measured is not clearly linked to the time value that this position is deemed to represent. This is awkward above all in the case of short durations, it being understood that the maximum value of the scale is generally sixty minutes. If, for example, it is desired under these conditions to fix a time of the order of one minute, the angular variation in the setting member is only a few degrees, which results in a tricky setting operation. Moreover, such timers do not allow the fixing of long time intervals, for example of the order of some hours.

SUMMARY OF THE INVENTION

The object of the invention is to provide a timer which is without these drawbacks.

The invention therefore relates to a timer of the above-defined type which is characteristised in that the setting device is of the stepping type and comprises a transducer for the position of the said setting member which is capable of generating of pulsed signal, the number of pulses of which represents the position of the setting member and, consequently, the interval to be measured, and that the counting means comprise an accumulator circuit connected, on the one hand, to the transducer to be loaded with the number of pulses produced by it and, on the other hand, to the time base to count a number of periods of the latter until there is coincidence of a value corresponding to this number of pulses, this accumulator circuit being also connected to the generating device to trigger this when the said value is reached.

The result of these characteristics is that the setting process is of an essentially discontinuous nature, which means that to each step of the setting member there always corresponds a predetermined number of reference periods. Thus, the capacity for measuring small intervals of time with precision depends only on the calibration of the setting device, it being possible for each step of the setting member to correspond to any length of time whatever chosen through construction.

Accordingly, the invention enables two different embodiments of the timer to be considered, one in which all the steps of the setting device correspond to an equal number of reference periods and another in which each step can correspond to a different number (low or high) of these periods.

According to a particularly advantageous characteristic of the invention, the timer is integrated in a timepiece of the wristwatch type, without being connected in spite of this to the mechanism or circuits which ensure in this piece indication of the official time, it being possible for the time base alone to be common to the two devices. In this application, it is advantageous to make the setting member of the timer in the form of a date disc capable of being actuated by the stem of the watch, which results in a particularly attractive assembly.

BRIEF DESCRIPTION OF THE DRAWINGS

The invention will be better understood by reading the description which is about to follow of several embodiments given solely by way of example, this description being given with reference to the accompanying drawings, in which.

DESCRIPTION OF THE PREFERRED EMBODIMENTS

The electromechanical clock device of which several embodiments are about to be described hereinafter can be used in an independent manner for carrying out a timer function or else be incorporated in a timepiece intended to permit the performance of this function and to indicate the official time. It is this second version which is chosen in all the examples described, but it will be understood that the invention is not limited to this sole use of the clockwork mechanism, it being possible for this to be carried into effect in an independent manner, whether in the form of a piece worn on the wrist or of a table piece, for example.

This having been established, reference will now be made to FIG. 1 which shows a general view of a first embodiment of the invention which concerns a wristwatch in which the clock device according to the invention has been incorporated.

Figure 1:
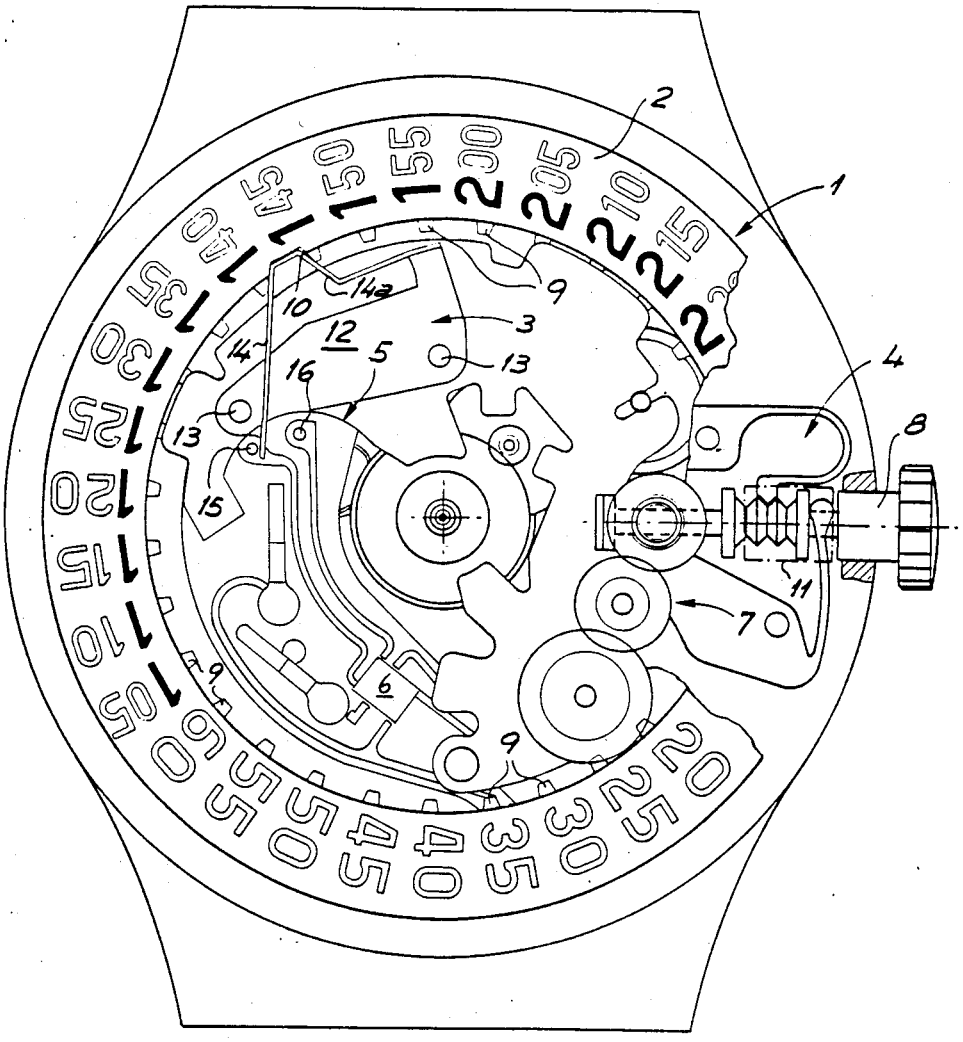
FIG. 1 is a diagrammatic representation, through a plan view partly broken away, of a first embodiment of the invention.

Consequently, in FIG. 1 there can be seen the essentials of the mechanical parts of the device, that is to say a position transducer 1 which is composed essentially of two subassemblies, namely a setting member or indicator disc 2 and a switch 3, and is associated with a setting assembly 4. According to a particular characteristic of the invention, in the limits of application to a watch, it is advantageous for the indicator disc 2 to replace the date disc and for the setting assembly to be that which is usually employed in a watch for setting the date. However, in contrast to a date indicating mechanism, the disc 2 is not driven by means of the train of the watch, but remains independent therefrom, so that the timer function of the assembly can be achieved independently of the indication of the official time.

The switch 3 is connected to a printed circuit 5 provided with an integrated circuit 6, the latter comprising not only the customary circuits necessary for carrying out the official time function, but also those which are required for carrying out the timer function, which part of the integrated circuit 6 will be described in detail in the description which is about the follow.

As the setting assembly 4 is designed in exactly the same way as an assembly known per se permitting setting or adjustment of the date disc, it is not necessary to give a detailed description thereof here. It is sufficient to point out that the disc 2 is driven by a setting train 7 when the stem 8 of the swatch is in its intermediate position, which is moreover shown in FIG. 1. Consequently, the stem 8 being in the position shown, it is possible to bring the disc into any one of 31 positions, this number being chosen to accord with the positions which are usual in a timepiece provided with a date indicator. However, it should be understood that this number is not restrictive and depends in particular on the length and the apportionment of the scale of the disc 2.

The disc 2 is therefore formed by an annular ring bearing on one of its faces information which represents time intervals in minutes distributed at intervals of five minutes at a time. In other words, the scale of the disc 2 in this case is linear.

The inner periphery of the disc 2 is provided with a toothing composed of teeth 9, on the one hand, and a single notch 10, on the other hand, the numbers shown on the disc appearing in succession behind a window 11 provided in the region of the stem 8 and permitting the user to read the length of time at which the timer is set.

The teeth 9 and the notch 10 cooperate with the switch 3. This comprises a plate 12 fixed to the watch mechanism at 13 and provided with a contact arm 14 which also constitutes a jumper for positioning the disc 2. This contact arm is electrically the movable contact of the switch 3, which moreover comprises two fixed contacts 15 and 16 on which the free end of the contact arm 14 can come to be applied selectively, it being understood that this arm also has an intermediate position in which it is not applied against any one of the contacts 15 and 16. It can be seen in FIG. 1 that electrical contact is established between the arm 14 and the contact 15 when the elbow-shaped bearing portion **14*a* of the arm 14 is lodged in the notch 10 of the disc 2**.

Figure 2:
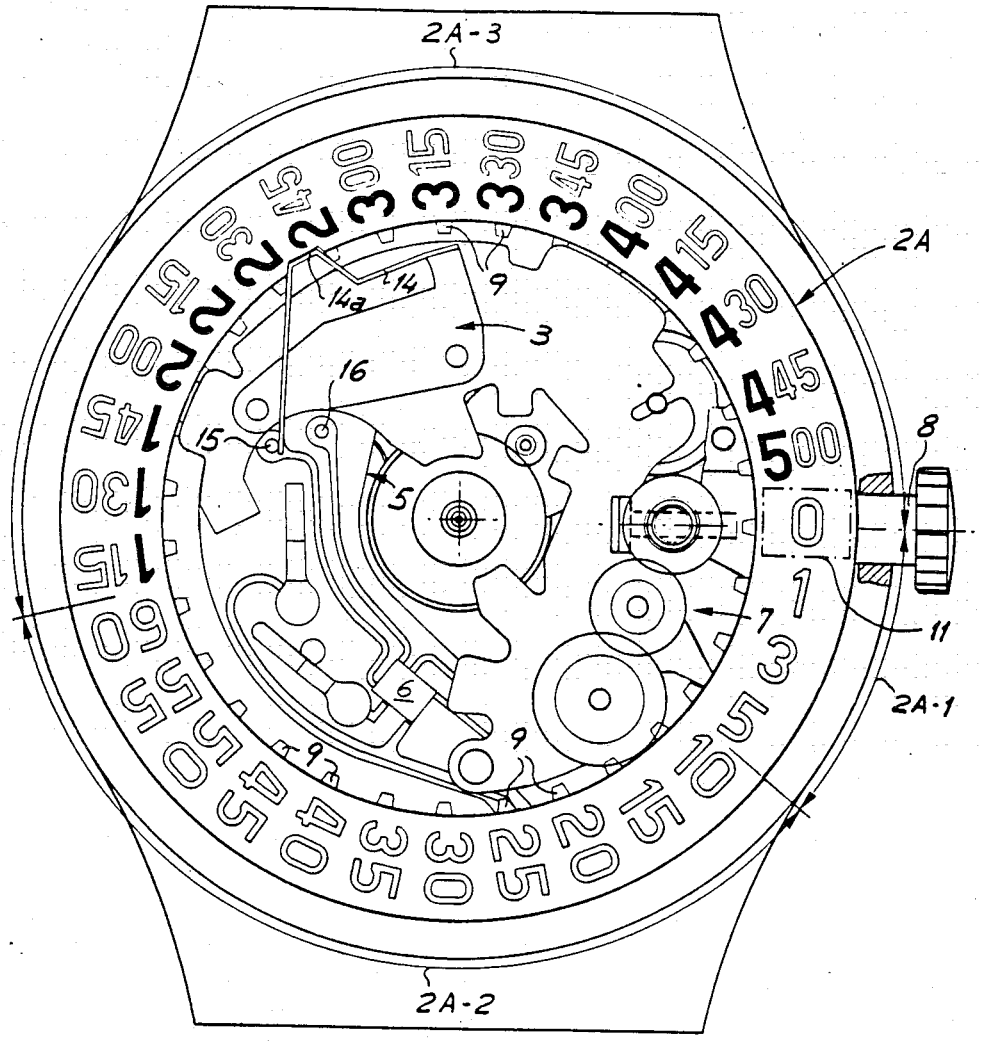
FIG. 2 is a similar view of a second embodiment of the invention.

FIG. 2 shows another embodiment of the invention according to which, in contrast to the embodiment of FIG. 1, there is provided an indicator disc 2A which does not comprise a linear scale graduated in minutes and extending by five minutes at a time, but a non-linear scale, that is to say commencing with a fine division in a first zone 2A-1 graduated in one, three and five minutes, a second zone 2A-2 graduated in intervals of five minutes, and a third zone 2A-3 graduated from quarter of an hour to quarter of an hour, up to a total of five hours.

Of course, the pieces shown in FIGS. 1 and 2 comprise a conventional electromechanical clockwork mechanism for driving hands indicating the official time, which elements are conventional and therefore do not require any detailed description here.

It is to be noted that FIGS. 1 and 2 show the inoperative position of the timer, that is to say the portion **14*a* of the contact arm 14 is resting in the notch 10, by means of which the figure O appears under the window 11**. It is assumed for the moment that the electronic circuits of the timer ar then cut out.

Figure 3:
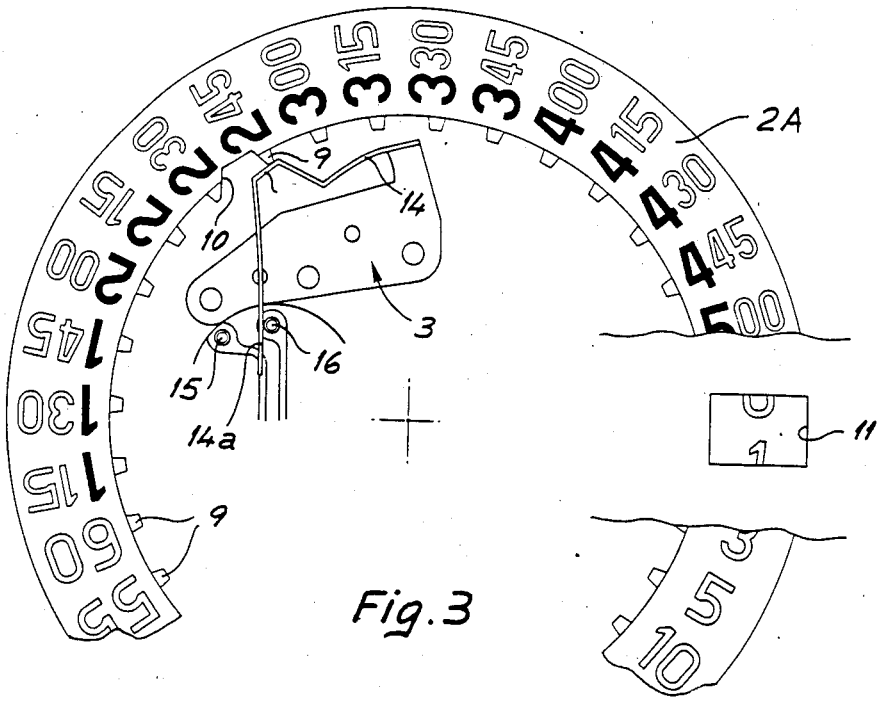
FIGS. 3 and 4 are diagrammatic views of a graduated disc and a transducer intended to supply a position signal.
Figure 4:
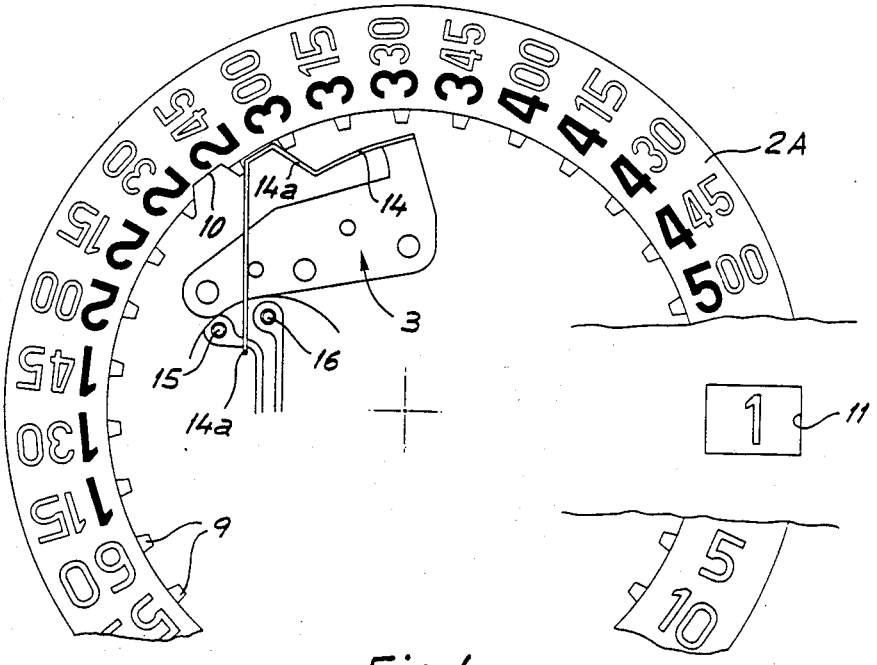

FIG. 3 shows the situation in which the disc 2A has been shifted by half a step from the zero position by turning the stem 8. The portion **14*a* of the contact arm 14 has therefore left the notch 10 to bear on the top of the first tooth 9 of the internal toothing of the disc. This brings about the shifting of the end of the arm 14 which comes in this way to bear against the contact 16 of the switch 3 to give rise to an electric pulse taken into account in the electronic circuit by a process which will be described hereinafter. After passing from the position of FIG. 3 to that of FIG. 4, the disc 2A again performs half a step, so that the portion 14*a* fits between the first and the second tooth 9 of the disc 2. It will be seen that under these conditions the end of the arm 14 does not bear either on the contact 15 or on the contact 16**, which constitutes for the electronic circuit a significant item of information which is exploitable as such.

It will be understood, therefore, that by turning the stem 8 in the position shown in FIG. 1, the end of the contact arm 14 bears periodically on the contact 16 to generate a train of pulses, the number of pulses being representative of the position or the shifting of the disc 2A or again of the duration of time interval chosen by the user.

It will be observed that in the variant of FIG. 1 each pulse generated in this way corresponds to a period of the same duration (five minutes), whereas in the variant of FIG. 2 some pulses correspond to a small duration, while others correspond to a greater duration.

Figure 5:
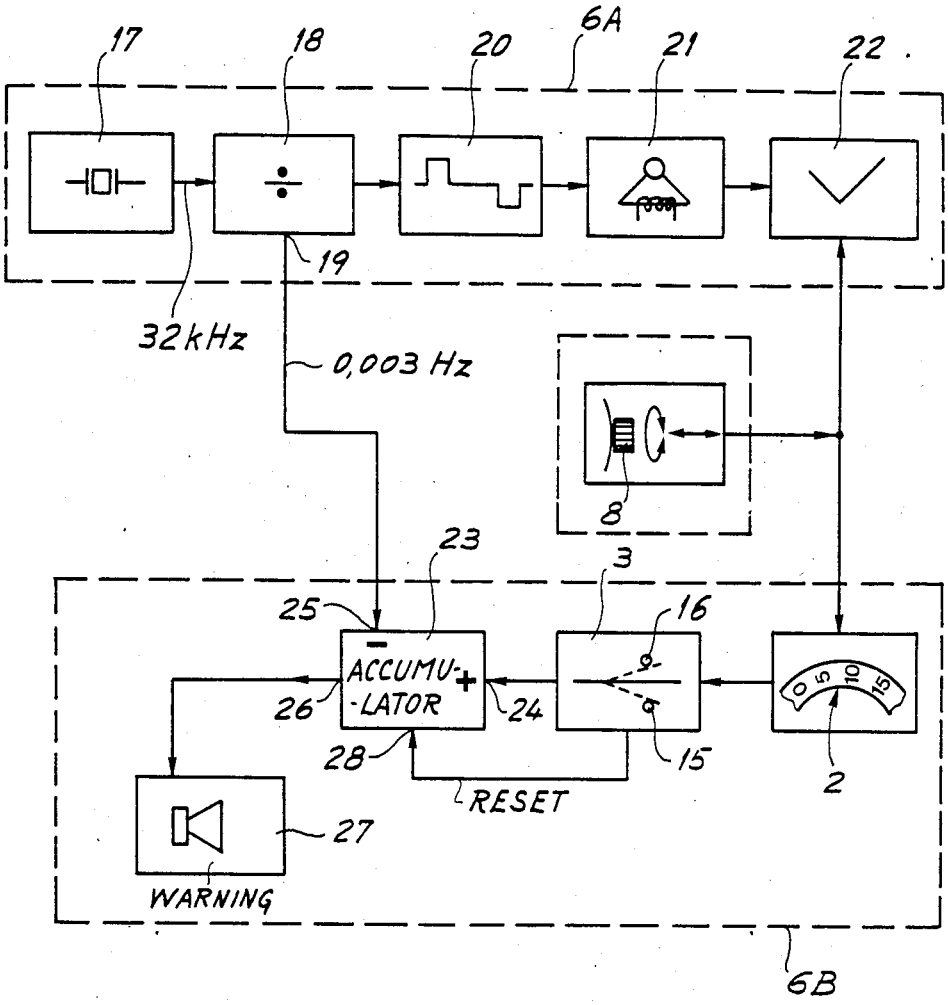
FIG. 5 is a very simplified diagram of the embodiment of FIG. 1.

FIG. 5 is a very simplified diagram of electrical connections of a circuit which can be used in the watch shown in FIG. 1, that is to say the one in which the disc 2 presents a linear graduation. This circuit, which is the one shown at 6 in FIG. 1, comprises a part 6A specifically intended for indicating the official time and a part 6B which ensures the timer function in cooperation with the disc 2 and the switch 3 as well as the stem 8.

In conventional manner, the part 6A comprises a quartz oscillator 17 supplying a signal whose frequency is about 32 kHz. This oscillator is connected to a divider 18 one of whose outputs 18 is connected to the part 6B of the circuit, the signal appearing at this output being constituted by a train of pulses in which these pulses are spaced apart by five minutes (0.03 Hz), at least in the example described here. The divider is connected in conventional manner to a shaping circuit 20 which is itself connected to a stepping motor 21 driving the hands 22 of the watch through the agency of a wheel train.

The switch 3 is connected to an accumualtor circuit 23 which, in this example, is a simple forward and backward counter, the forward counting input 24 being connected to the contact 16 of the switch, the backward counting input 25 to the output 19 of the divider and the zero output 26 to a warning device 27 supplying an audible signal, or some other similar signal, when the forward and backward counter 23 arrives at the 0 position. This counter also comprises a reset input 28 to which the contact 15 is connected. The warning device 27 is provided with a timing set-up to ensure the production of an alarm signal during a certain time only, after the forward and backward counter 23 has reached its 0 position.

The operation of the circuit of FIG. 5 is as follows. When the user wishes to use the timer to fix an interval of time to be measured, it is sufficient for him to put the stem 8 into the second position represented in FIG. 1 and drive the disc until the figure corresponding to the desired duration in minutes appears behind the window 11. The switch 3 has first left the 0 position (FIG. 1) then to command the forward and backward counter in rhythm with the passage of the teeth 9 in front of the portion 14*a* of the contact arm 14. The forward and backward counter has therefore registered a certain number of pulses corresponding to as many periods of five minutes as make up the space of time to be measured. Once this space of time has been set, the time base formed by the oscillator 17 and the divider 18 causes the countdown of the contents of the forward and backward counter 23 at the rate of one pulse every five minutes, the period to be measured being at an end when the forward and backward counter 23 arrives at 0. It is at this moment that the alarm 27 acts to warn the user that the space of time has elapsed. In this case, the reference period used is therefore five minutes, this period being obtained at a special output 19 of the divider 18.

It can therefore be seen that the timer is totally independent of the indication of the official time, which continues to be displayed in a completely separate manner although the same time base is used in both cases. This means, however, that a timer without any indication of the official time can easily be devised, whether this be in the form of a piece having to be worn on the wrist or a piece of some other nature, because it is sufficient simply to omit the elements 20, 21 and 22 in FIG. 5. Such a variant therefore comes expressly within the limits of the invention.

In the limits of a wristwatch, the disc 2 can advantageously replace the date disc without considerably changing the design of the timepiece itself. It will be noted, furthermore, that the precision of measurement of the space of time depends ultimately on that of the time base, which can be very good, that is to say that of conventional quartz watches. In fact, the positioning of the disc 2 being ensured in steps due to the jumper and being translated into a pulse train, any pulse freshly acquired by the forward and backward counter 23 will give rise to the establishment of a period of exactly five minutes counted down by the time base 17,18. The precision is therefore in no way dependent on exact positioning of the disc 2 and the user does not have to worry himself about this. In conventional timers, on the other hand, the setting disc does not have well-defined positions, so that, above all in the case of small intervals of time, it is difficult to adjust it precisely in a position corresponding to the desired interval. Finally, adjustment of the position of the switch 3 with respect to the disc 2 is not critical because the signal is obtained by means of the jumper formed by the contact arm 14.

Figure 6:
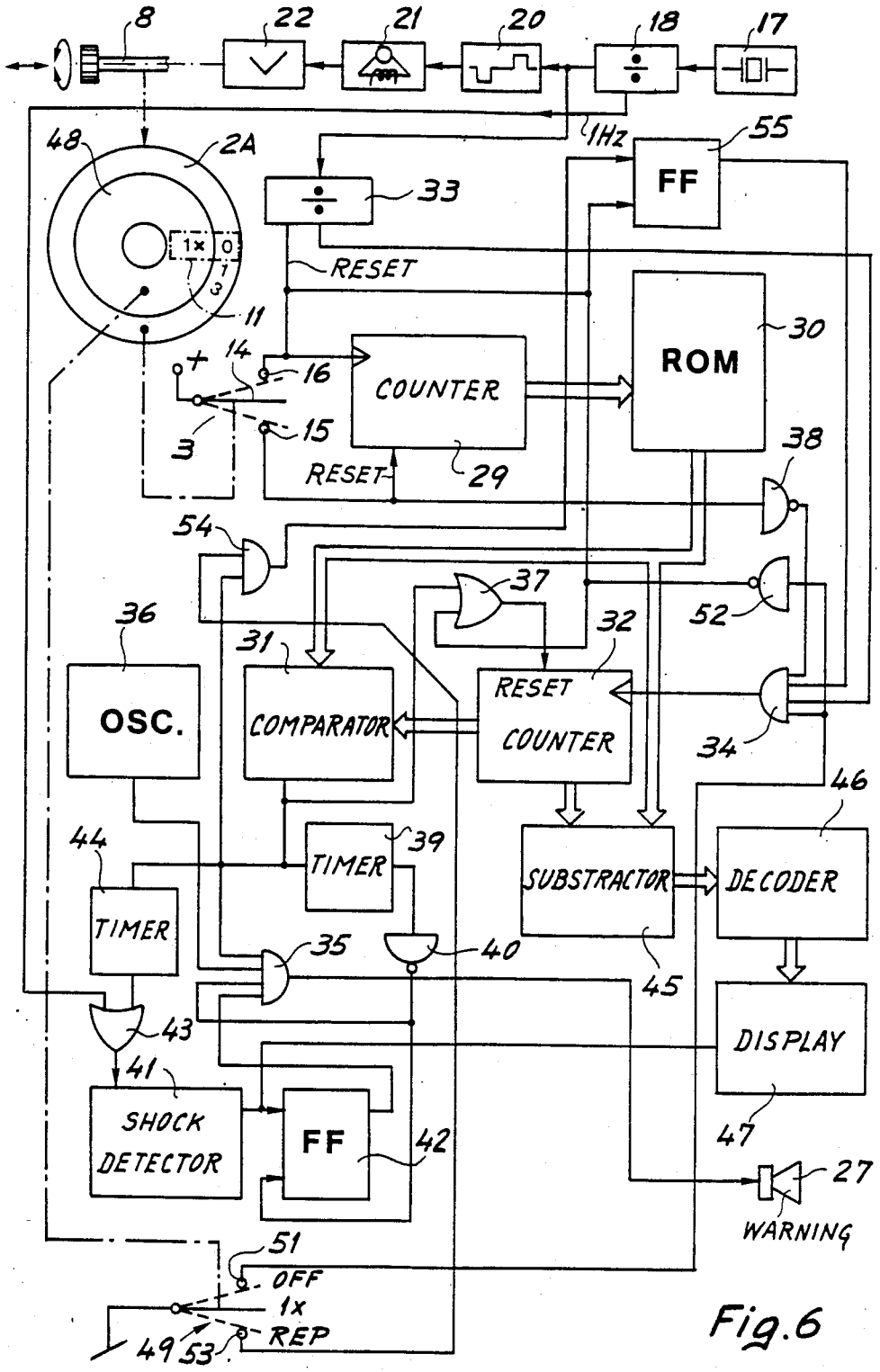
FIG. 6 is a simplified diagram, more detailed than that of FIG. 5, of the embodiment shown in FIG. 2.

Referring now to FIG. 6, there will be described the example of a circuit which can be utilized with a timer of the type shown in FIG. 2, that is to say in which the graduation carried on the disc is not linear. The obvious advantage of such a scale is that the user can set spaces of time of very short duration and very long duration by using the same setting system, the invention acquiring the special feature that, whatever the period chosen, the precision remains always linked to that of the time base which, as already indicated, can be very good.

The elements already described in connection with the preceding Figures are found again in FIG. 6, that is to say the chain for indicating the official time with the time base 17, the divider 18, the disc 2A, the switch 3 with its elements 14 to 16 and also the stem 8 enabling the disc 2A to be positioned. It will be observed that here likewise the timer can be used independently or be associated with a device indicating the official time, as in the case described hereinbefore.

In the circuit of FIG. 6 there is likewise provided an accumulator device for the pulses which are generated when the disc 2A is set in rotation by means of the stem 8. This accumulator device comprises in this case a counter 29 whose counting input is connected to the contact 16 and whose output represents in a plurality of bits the number that the counter contains. This output is connected in parallel to the address inputs of a permanent memory 30 which constitutes a scale conversion matrix. Consequently, the position of the counter 29 constitutes the address of this matrix which, in each of its bytes, stores a number corresponding to the duration of the intervals of time to be measured. This number may be expressed, for example, in minutes or in any other desired unit of time. In the present case, this unit is the minute. Thus, to each address of the memory 30 there corresponds a certain number of minutes, so that as a function of the contents of the bytes of the memory a "scale conversion" as it were can be obtained with respect to the successive steps that the disc 2A makes when it is set in rotation with the aid of the stem 8. On that account, the "conversion factor" may be any whatsoever for each step of the disc 2A, because according to the prior programming of the memory any number whatsoever of minutes to be counted down by the timer may correspond to each number accumulated in the counter 29. This arrangement therefore provides great flexilibity of carrying into effect of the timer, the sole limitation on design being the number of steps that the disc 2A can make and the capacity of the counter 29 and of the memory 30. In the case represented, which is that in which the timer is incorporated in a wristwatch and in which the disc 2A replaces the date disc, the number of positions of this disc is advantageously thirty-one, which permits the use of a disc whose construction is absolutely identical to that of a conventional date disc apart, of course, from the inscriptions which are carried thereon.

The data output of the memory 30 is applied in the form of an eight-bit word, for example, to one of the inputs of a comparator 31, the other input of which, likewise an eight-bit input, is connected to a counter 32 intended to receive counting pulses at its counting input from a dividing circuit 33. The output of the latter supplies a pulse every minute, for example. The corresponding pulses pass through an AND gate 34 permitting the passage of these pulses which are supplied in reality by the time base of the timer.

The output of the comparator 31 is connected to an AND gate 35 for permitting the passage of the signals commanding the alarm generator 27. This AND gate is also connected to an oscillator 36 which is intended to supply a train of pulses to the device 27, this train of pulses being able to give rise to an audible alarm signal of any nature, as is well known in the art.

In addition to the contact 16 being connected to the counting input of the counter 29, it is also connected to the reset input of the divider 33 in order that, after the emission of each pulse by the switch 3, the countdown of the period of time to be measured can commence at the beginning of a minute. In fact, it will be observed that, the divider 18 supplying a signal with a frequency of 0.5 Hz, the divider 33 divides this signal by 30, so that its output supplies a pulse every sixty seconds.

The contact 16 is also connected to a first input of an OR gate 37 whose other input is connected to the output of the comparator 31 and whose output is connected to the reset input of the counter 32. The latter is therefore reset either when the switch 3 emits a pulse or when the comparator establishes equality between the contents of the counter 32 and the data output of the memory 30.

The contact 15 is connected to the reset input of the counter 29 and also through the medium of an inverter 38 to a second input of the AND gate 34. In other words, when the disc has been brought back to the 0 position, the counter 29 is reset and the pulses of the time base can no longer reach the counting input of the counter 32.

The activation of the alarm signal generator 27 is subject to certain conditions. Thus, the output of the comparator 31 which initializes the production of the warning signal is connected to a timing circuit 39 with a duration of ten seconds, for example, which is connected to one of the inputs of the AND gate 35 through the medium of an inverter 40. This gate is therefore conducting only during the on time of the timing circuit 39, so that the signal coming from the oscillator 36 can be transmitted to the generator 27 only during this time.

In the embodiment shown in FIG. 6, the timer comprises with advantage a shock detector 41 incorporated in the case of the timepiece and supplying a signal when the user applies a shock to the latter. The output of this detector is connected to the reset input of a flip-flop 42, the output of which is connected to a fourth input of the AND gate 35 and the triggering input of which is connected to the output of the inverter 40. This shock detector 41 is of the type which must be activated by an activating input, which is achieved in the example described through the medium of an OR gate 43, a first input of which is connected to the output of the comparator 31 through the medium of a timing circuit 44 set at a few seconds, the other input of the OR gate 43 being connected to the 1 Hz output of the divider 18. In this way, the detector 41 is activated periodically or an instant after establishment by the comparator 31 of equality at its two inputs. Thus, it is possible for the user to stop the production of the alarm signal even within the period of time set by the timing circuit 39.

The example of FIG. 6 also comprises a subtracter 45, a first input of which is connected to the output of the counter 32 and the other input of which is connected to the data output of the memory 30, so that this subtracter can set up at its output a number which is the difference between the number of minutes already counted down and the number of minutes having to be counted down in all. The output of the subtracter 45 can thus be connected to a decoder 36 connected to a display device 47 for the time which still remains to be counted down. This display device could be constituted by a liquid crystal display or any other similar system.

In the fashion of the fitting of a day disc, the mechanical construction of which will be described in detail later on, the example of FIG. 6 further comprises a second disc 48 disposed concentrically inside the disc 2A and bearing on its face visible below a portion of the window 11 three indications corresponding respectively to the "off", "1×" and "repeat" functions, Mechanically, this disc 48 is coupled to a switch 39 having three positions corresponding respectively to the indications carried on the disc 48. The movable contact 50 of this switch is connected to earth, while one of the fixed contacts 51 is connected to an inverter 52 and a fourth input of the gate 34. In this way, when the switch 49 is in the corresponding position, the time base pulses coming from the divider 33 can no longer reach the counter 32. Moreover, this same signal resets this divider 33 through the medium of the inverter 52, the counter 32 being also reset through this inverter and the OR gate 37.

The other fixed contact 53 of the switch 49 is connected to a first input of an AND gate 54, the other input of which is connected to the output of the comparator 31. The output of this same gate is connected to the reset input of a flip-flop 55, the triggering input of which is connected to the contact 16 of the switch 3.

This circuit operates in the following manner. When the discs 2A and 48 are located in their "zero" and "off" positions, respectively, the switches 3 and 49 are bearing on their contacts 15 and 51, respectively. All the circuits and in particular the counters 29 and 32 are then reset.

In order to measure a space of time, the user first puts the stem 8 into the second pulled-out position (that is to say that in which, in a conventional watch, it enables the dates and days to be set or adjusted). By turning the stem in one direction, the user shifts the disc 48 towards the "1×" position, then by turning the stem in the other direction he selects the duration of the space of time by observing the figures moving past in procession behind the window 11. As soon as the spring 14 leaves the notch 10 (FIGS. 1 to 3), the change-over switch 3 leaves the contact 15 and, passing in front of the teeth 9, pushes its arm against the fixed contact 16, the result of which is the emission of a number of pulses corresponding to the number of steps carried out by the disc 2A. This number is recorded in the counter 29. At the same time, the addresses of the memory 30 are run through in succession until, when the disc 2A stops, the address is reached at which the time value corresponding to the chosen space of time is recorded. As soon as the disc 2A has stopped and the switch 3 is again immobilized in its neutral position, the AND gate 34 allows the time base pulses (reference periods) to pass through and these are applied in this way to the counter 32. This therefore begins to count at the rate of one step per minute. When there is equality between the contents of this counter and the number supplied by the memory 30, the comparator signals the equality and supplies at its output a signal which opens the AND gate 35. The sound generator 27 is then activated as already described hereinbefore. As soon as the comparator establishes equality, the counting of the time base is inhibited through the AND gate 54 and the flip-flop 55, which closes the AND gate 34. The user can stop the sound generator 27 at will with the aid of the shock detector 41. In fact, this detector can cause the flip-flop 42 to change over and thus close the AND gate 35. It will also be observed that this gate remains open only during a predetermined time fixed by the timing circuit 39 which is connected to one of the inputs of this gate through the inverter 40.

If, at the outset, the user has placed the switch 49 in the "repeat" position, the AND gate 54 is closed and the equality signal of the comparator cannot reach the flip-flop 55. On this account, a fresh count-down of the space of time can occur.

So far, two embodiments have been described in which the disc 2 or 2A can be shifted only for setting the space of time to be measured, so that this disc cannot itself give evidence of the time which still remains to be counted down.

Figure 7:
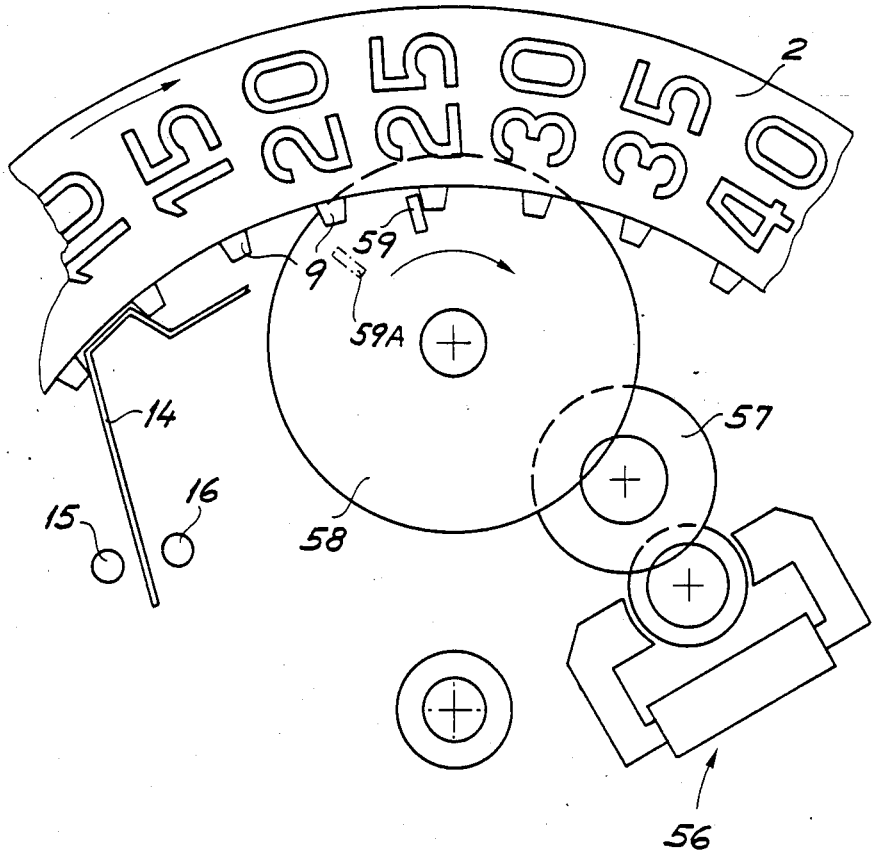
FIG. 7 represents a partial view of a third embodiment of the invention.

On the other hand, in the embodiment which will now be described, the disc 2 has the dual role of enabling the user to set the space of time to be measured and of indicating, during the measurement of this space of time, the period which still remains to be counted down. In FIG. 7 there is shown a method of driving the disc 2 which, in other respects, has the same form as that of the version of FIG. 1. However, in this case, a stepping motor 56 is moreover provided which, through the medium of a transmission wheel and pinion 57, drives a wheel 58 provided with a dog 59 cooperating with the teeth 9 of the disc 2. The stepping motor 56 can be supplied with a frequency of 32 Hz, for example. Of course, the disc 2A can be provided with an identical mechanism.

Figure 8:
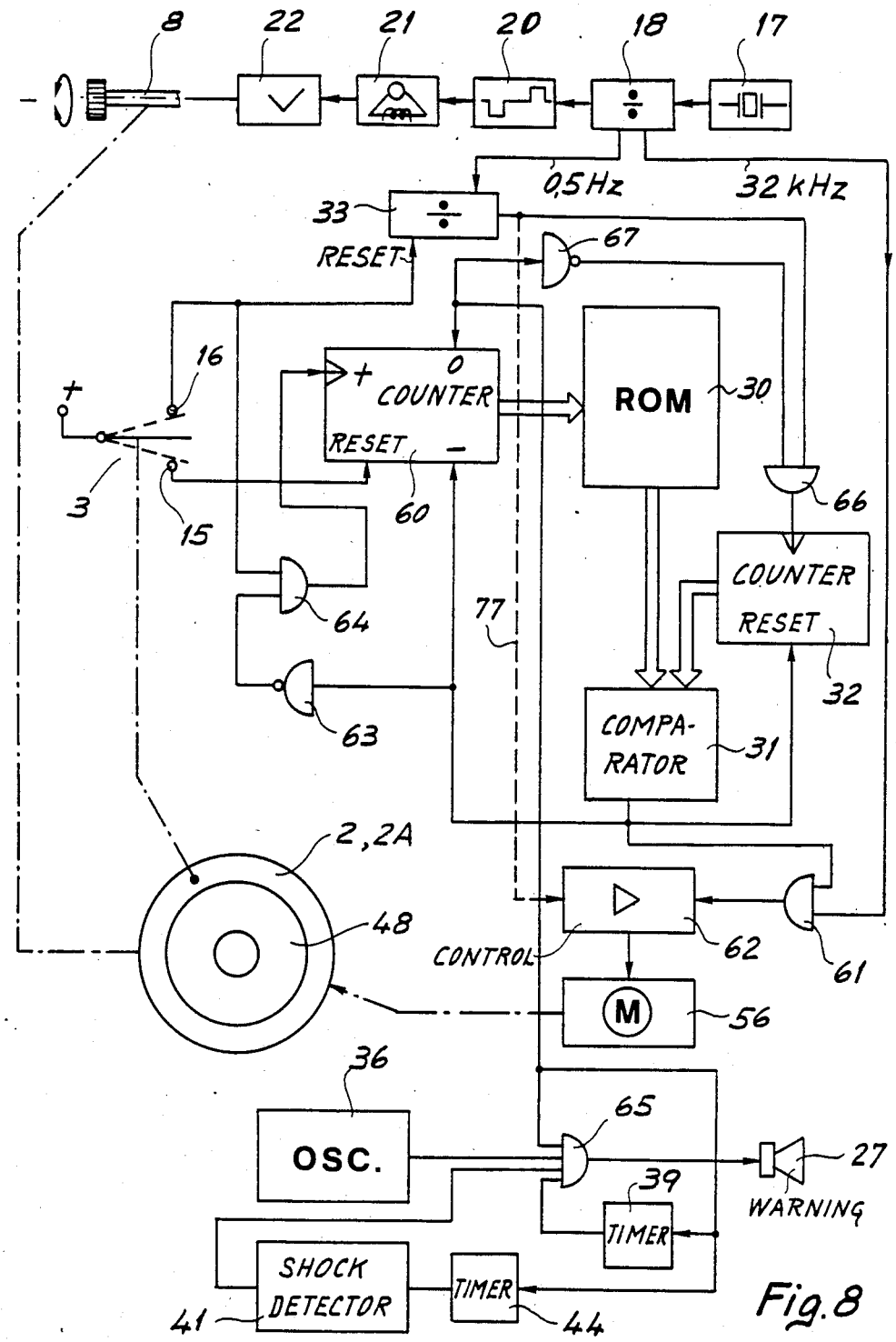
FIG. 8 is a simplified circuit diagram thereof.

FIG. 8 shows an example of an electronic circuit which can be used in this last case. The elements already described in connection with FIG. 6 are shown in this Figure with the same numerical references. The circuit which is connected to the contact 16 of the switch 3 and to the memory 30 is in this case a forward and backward counter 60 which counts the pulses originating from the switch 3 and deducts the output pulses of the comparator 31. The latter is connected as before to the data output of the memory 30 and to the output of the counter 32, the latter counting the pulses coming from the divider 33 at the rate of one pulse per minute.

However, the contents of the memory 30 are not the same as those of the memory 30 of the embodiment of FIG. 6. In fact, in this instance, to each address of the memory 30 there corresponds a value which is the difference between two successive durations displayed on the disc 2A.

Thus, when the comparator 31 establishes equality between the contents of the counter 32 and of the data output of the memory 30, it applies an output signal to an AND gate 61, the other input of which is connected to a 32 Hz output of the divider 18. The output of this AND gate 61 is connected to a control of the motor 56. Consequently, in the case of equality, the motor 56 is activated by 32 pulses to bring the disc 2 or 2A one step backward.

The meshing ratios between the rotor of the motor, the wheel and pinion 57 and the wheel 58 are chosen in such manner that the 32 pulses are sufficient to cause the wheel 58 to make one revolution. In its inoperative position, the latter is located in such manner that the dog 59 is in the position 59A shown by a chain-dotted line (that is to say in which this dog escapes the toothing of the disc 2 or 2A). Thus, the dog 59 does not oppose the setting of the disc through the agency of the stem 8, which is coupled thereto by the conventional setting mechanism (not shown). However, as soon as the motor 56 is activated, the dog 59 knocks against a tooth of the disc to cause it to move back by one step (which transitory position is shown in FIG. 7).

During this reverse movement of the disc, the switch 3, in spite of the fact that the contact 16 again records a pass in front of a tooth 9, remains inoperative for increasing the contents of the counter 60, since the output of the comparator 31 inhibits the counting input thereof through an inverter 63 and an AND gate 64. WHen the comparator 31 establishes equality, the counter 31 is reset.

Thus, at the end of the measurement of an interval of time corresponding to a graduation of the disc, this is brought back one step, the memory supplies a fresh value and the counter 32 recommences to count the pulses of the divider 33.

The forward and backward counter 60 also comprises a "0" output which is activated when its contents reach zero. This output is connected to an AND gate 65 which commands the alarm device 27. This gate is also connected to the oscillator 36, the shock detector 41 and the timing circuit 39 (limitation of the alarm time), the shock detector being associated with its own timing circuit 44.

The zero signal of the forward and backward counter 60 is also transmitted to an AND gate 66 through the medium of an inverter 67 in order to block any fresh counting by the counter 32.

Moreover, in returning to zero, the disc 2A restores the switch 3 to the position in which the contact 15 is activated. This can reset the forward and backward counter 60 in the event of the user wishing to put an end prematurely to the operation of the timer.

In the variant of FIG. 8, the disc 48 can obviously also be designed for carrying out the "off", "1×" and "repeat" functions by utilizing circuit elements identical to those appearing in FIG. 6.

Figure 9:
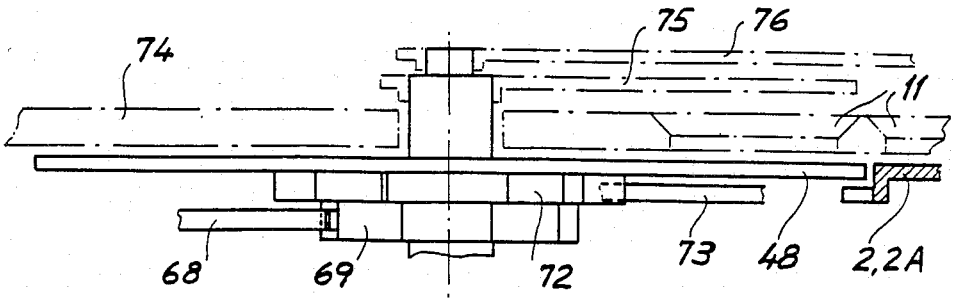
FIGS. 9 and 10 show diagrammatically how the clockwork mechanism according to the invention can be provided with a start-stop control device.
Figure 10:
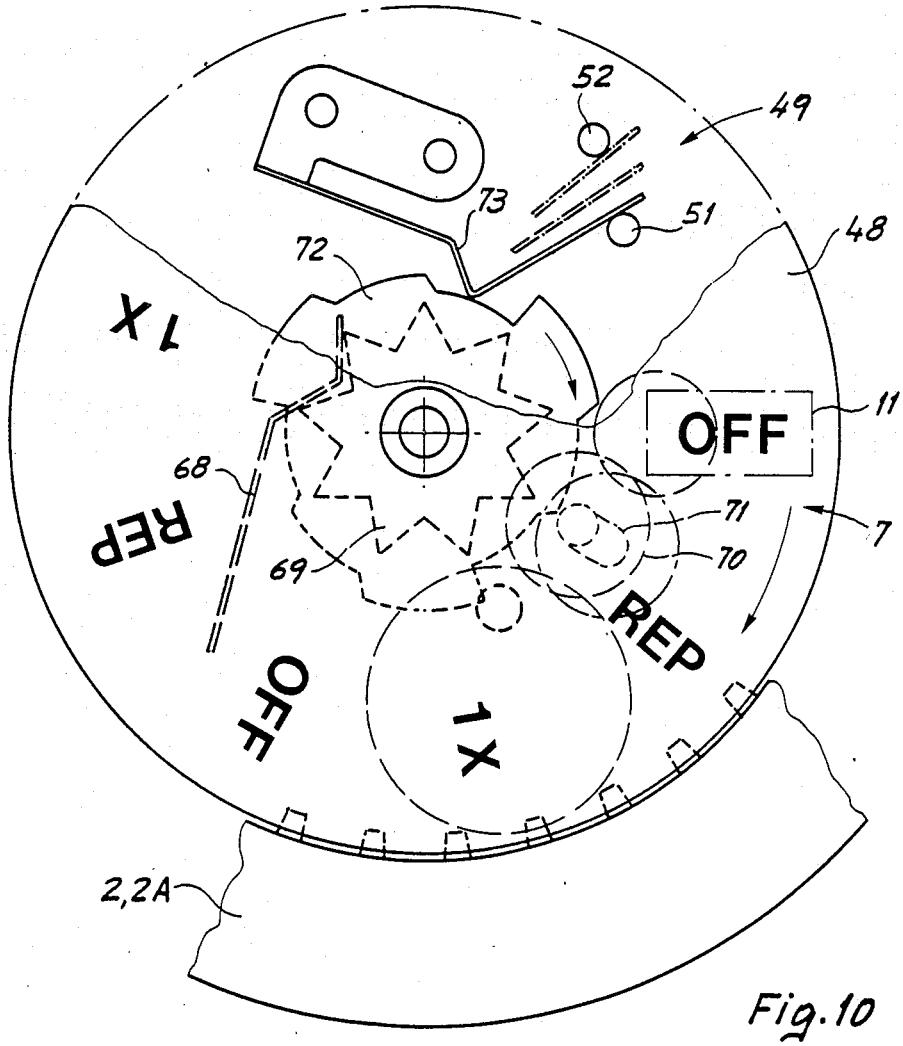

FIGS. 9 and 10 show an embodiment of the mechanism associated with the disc 48. This is designed so as to be able to occupy a multiple of three positions (nine in this case) corresponding each time to the above-indicated functions. As in the case of a conventional day disc, thees positions are fixed by a jumper 68 and a star wheel 69 which in this instance has nine arms and with which a wheel and pinion 70 meshes. The latter forms part of the setting mechanism (see FIGS. 1 and 2) and is movable rotatably and also in translation due to a guide 71 of bean shape. In this way, in well-known manner, the stem 8 (not shown here) can drive the star wheel 69 when it is turned in one direction and drive the disc 2 or 2A when it is turned in the opposite direction, the wheel and pinion 70 then moving from one end of the guide 71 to the other. The star wheel 69, which is naturally fast with the disc 2 or 2A, is fixed to it through the medium of a three-level peripheral cam 72 with which the contact spring 73 of the switch 49 cooperates. It will be understood that in this way each of the positions of the disc 48 corresponds to one of the three possible positions of this switch 49.

Figure 11:
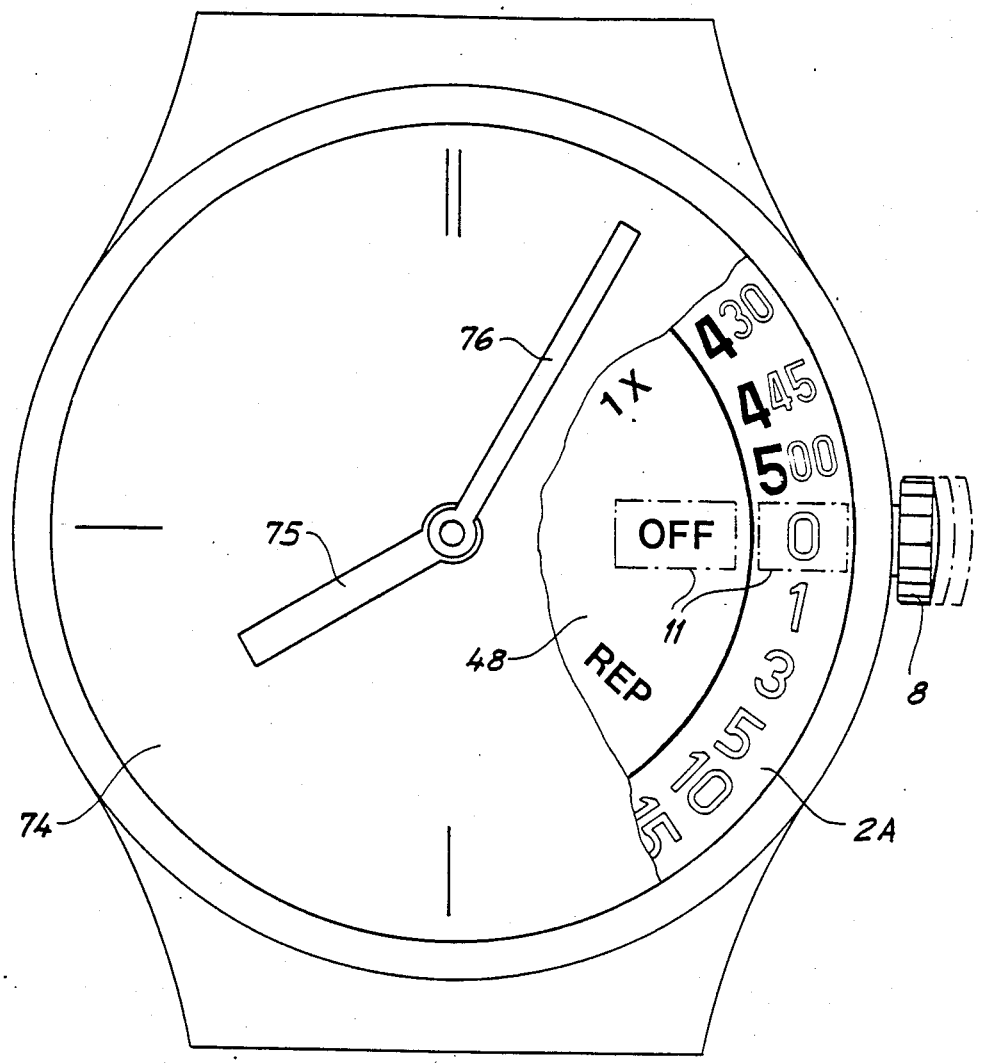
FIG. 11 is a view similar to those of FIGS. 1 and 2 of a watch incorporating a timer according to the invention.

As can be seen in FIGS. 9 and 11, the discs 2, 2A and 48 can be located directly below the dial 74 of a watch provided with the timer and indicating the official time with the aid of its hands 75 and 76.

However, the timer according to the invention can be used independently without a device indicating the official time being necessarily associated therewith.

Finally, it will be noted that the embodiment of FIG. 8 can be applied in the case where the disc comprises a linear graduation. It is then unnecessary to use the memory 30, the comparator 31 or the counter 32. On the other hand, a direct connection 77 (FIG. 8) must then connect the divider 33 to the control circuit 62 of the motor 56.

We claim:

1. Electromechanical timer comprising a time base establishing a constant reference period, a device for setting the interval of tiem to be measured, including a setting member provided with a scale calibrated in units of time, a device for generating an alarm signal, and means for counting the number of reference periods contained in said interval and, on timing-out, for triggering said generating device, wherein said setting device is of the stepping type and comprises a transducer for the position of said setting member which is capable of generating a pulsed signal, the number of pulses of which represents the displacement of said setting member and, consequently, the interval to be measured, and wherein said counting mans comprise an accumulator circuit connected to said transducer to be loaded with the number of pulses produced thereby and connected to said time base to count a number of periods of the latter until there is coincidence of a value corresponding to said number of pulses, said accumulator circuit being also connected to said generating device to trigger this device when said value is reached, wherein said accumulator circuit comprises a first counter for storing the number of pulses of said pulsed signal, a second counter, a scale conversion matrix capable of producing a time value for each pulse generated by said transducer, and a comparator, said matrix being connected to one of the inputs of said comparator which is connected at its other input to said second counter connected to said time base for storing reference periods of the latter, and said comparator being connected to trigger said alarm signal generating device when it establishes equality of the values applies at its two inputs, said setting member having a non-linear scale.

2. Timer according to claim 1, wherein said setting member is coupled to a motor for restoring said member to its initial position during the counting of the number of reference periods comprised in the said interval of time to be measured.

3. Timer according to claim 2, wherein said setting member is coupled to a motor for restoring said member step by step to its initial position during the counting of the number of reference periods comprised in the said interval of time, said first counter is an up-down counter, the output of said comparator being connected both to the down counting input of said first counter and to said motor to cause the counting down of said first counter by one unit and the backward movement of the setting member by one step in the case of equality of the signals applied at the inputs of the comparator, said first counter also having a zero position output which is connected to said device generating a warning signal when said first counter reaches the zero position, and said matrix comprises, for each position of said first counter, a different time value which is a fraction of the interval of time to be measured corresponding respectively to the steps of said setting member.

4. Timer according to claim 1, wherein said transducer comprises a switch which is connected to said counter for incrementing the contents thereof each time that it is actuated, said setting member comprises a series of teeth having one tooth per division of its scale, and said switch cooperates with said teeth to be actuated on the passage of each tooth.

5. Timer according to claim 4, wherein said switch is a change-over switch with a first fixed contact connected to said accumulator circuit and a second fixed contact forming a reset contact for said accumulator circuit and which is actuated when said setting member is in its zero position.

6. Timer according to claim 1, wherein said setting member is in the form of an annular disc.

7. Timer according to claim 6, wherein said timer is incorporated in a watch having a stem, and said setting member is fitted in the watch like a conventional date disc in order that said setting member can be actuated by the stem of the watch, and further comprising a second setting member for control of the timer's starting and stopping, said second setting member comprising a second disc fitted in the watch like a conventional day disc of said watch, and this second disc being associated with a switch actuated by a cam fast with said second disc and connected for starting or stopping the circuits of the timer.

8. Electromechanical timer comprising:

a time base for generating regularly spaced time pulses establishing a constant reference period;

a device for setting the interval of time to be measured, said setting device comprising:

(i) a setting member capable of being placed in a plurality of positions corresponding to predetermined time intervals respectively, said setting member being provided with a scale calibrated in units of time for the display of said predetermined intervals; and (ii) transducer means operatively associated with said setting member for generating setting pulses, each time said setting member is moved from one position to a subsequent position;

up-down counter means comprising an up input, a down input and a triggering output, said up input being connected to said transducer means in such a manner that the contents of said counter means is increased in response to said setting pulses, said down input of said counter means being connected to said time base in such a manner that the contents of said counter means is decreased in response to said time pulses; and a device for generating an alarm signal, connected to said triggering output of said counter means so as to be triggered when the contents of said counter means reaches zero value.

9. Electromechanical timer as claimed in claim 8 wherein said predetermined time intervals defined by the respective positions of said setting member are all the same, said scale of said setting member being linear.

10. Electromechanical timer according to claim 8 wherein said transducer means comprises a switch which is connected to said up input of said up down counter means for incrementing the contents thereof each time that said switch is actuated, and wherein said setting member comprises a series of teeth having one tooth per division of its scale, and said switch cooperates with said teeth to be actuated on the passage of each tooth.

11. Electromechanical timer according to claim 10, wherein said up-down counter means also comprises a reset input and said switch is a change-over switch with first fixed contact connected to said up input of said up-down counter means and a second fixed contact connected to said reset input of said up-down counter means and which is actuated when said setting member is in its zero position.

12. Electromechanical timer according to claim 8 wherein said setting member is in the form of an annular disc.

13. Electromechanical timer according to claim 8 wherein said setting member is coupled to a motor for restoring said member to its initial position during the decrease to zero value of the contents of said up-down counter means.

14. A timepiece comprising in combination:

(a) standard time indicator means comprising:

a time base for generating regularly spaced time pulses establishing a constant reference period;

a divider circuit responsive to said time base for generating a first pulse train and a second pulse train;

control circuit means connected to said divider circuit for receiving said first pulse train;

motor means responsive to said circuit means;

a dial comprising a display opening;

hands cooperating with said dial for displaying standard time, said hands being coupled to said motor means for being driven thereby in dependency from said first pulse train; and (b) electromechanical timer means comprising a setting member fitted like a conventional data disc and capable of being placed in a plurality of positions corresponding to predetermined time intervals respectively, said setting member being provided with a scale calibrated in units of time for the display of said predetermined intervals through said display opening;

transducer means operatively associated with said setting member for generating setting pulses, each time said setting member is moved from one position to a subsequent position;

up-down counter means comprising an up input, a down input and a triggering output, said up input being connected to said transducer means in such a manner that the contents of said counter means is increased in response to said setting pulses;

said down input of said counter means being connected to said time base for receiving said second pulse train generated by said time base in such a manner that the contents of said counter means is decreased in response to the pulses of said second pulse train;

a device for generating an alarm signal, connected to said triggering output of said counter means so as to be triggered when the contents of said counter means reaches zero value;

said timepiece further comprising a stem coupled to said hands in a first position for adjusting standard time displayed by said hands and coupled to said setting member in a second position for the selection of time period of said electromechanical timer.

15. A timepiece as claimed in claim 14 wherein said transducer means comprises a switch which is connected to said up input of said up-down counter means for incrementing the contents thereof each time said switch is actuated, said setting member comprising a series of teeth cooperating with said stem and having one tooth per division of its scale, and said switch cooperates with said teeth to be actuated on the passage of each tooth upon rotation of said stem in said second position.

16. A timepiece as claimed in claim 14 wherein said up-down counter means also comprises a reset input and said switch is a change-over switch with a first fixed contact connected to said up input of said up-down counter means and a second fixed contact connected to said reset input of said up-down counter means and which is actuated when said setting member is in its zero position.

17. A timepiece as claimed in claim 14 wherein said electromechanical timer further comprises a second setting member for control of its starting and stopping said second setting member being associated with a switch actuated by a cam rigid with said second setting member and connected for enabling or disabling said electromechanical timer.

18. A timepiece as claimed in claim 17 wherein said second setting member is fitted like a conventional day disc of said timepiece and wherein said stem is coupled to said second setting member so as to allow adjustment thereof in said second position of said stem.

19. A timepiece comprising in combination:

(a) a standard time indicator means comprising:

a time base for generating regularly spaced time pulses establishing a constant reference period;

a divider circuit connected to said time base for generating a first pulse train and a second pulse train both related to said constant reference period;

control circuit means connected to said divider circuit for receiving said first pulse train;

motor means responsive to said circuit means;

a dial comprising a display opening;

hands cooperating with said dial for displaying standard time, said hands being coupled to said motor means for being driven thereby in dependency from said first pulse train;

a stem capable of being placed in a first and a second position, said stem in said first position being coupled to said hands for adjustement of standard time displayed by said timepiece: and (b) an electromechanical timer comprising:

a device for setting the interval of time to be measured, including a setting member proivded with a scale calibrated in units of time, said scale being so arranged as to be visible through said display opening of said dial, said stem in said second position being coupled to said setting member for adjustment of said interval of time to be measured;

means for counting the number of pulses of said second pulse train contained in said interval and, on timing out, for triggering said generating device, said setting device being of the stepping type and comprising a transducer for the position of said setting member which is capable of generating a pulsed signal, the number of pulses of which represents the displacement of said setting member and, consequently, the interval to be measured, and wherein said counting means comprise an accumulator circuit connected to said transducer to be loaded with the number of pulses produced thereby and connected to said time base to count a number of pulses of the second pulse train until there is coincidence of a value corresponding to said number of pulses, said accumulator circuit being also connected to said generating device to trigger this device when said value is reached, said accumulator circuit comprising a first counter for storing the number of pulses of said pulsed signal, a second counter, a scale conversion matrix capable of producing a time value for each pulse generated by said transducer, and a comparator, said matrix beng connected to one of the inputs of said comparator which is connected at its other input to said second counter connected to said time base for storing reference periods of the latter, and said comparator being connected to trigger said alarm signal generating device when it establishes equality of the values applied at its two inputs, said setting member having a non-linear scale.

20. A timepiece as claimed in claim 19 wherein said setting member is coupled to a motor for restoring said member to its initial position during the counting of the number of reference periods comprised in the said interval of time to be measured.

21. A timepiece as claimed in claim 20 wherein said setting member is coupled to a motor for restoring said member step by step to its initial position during the counting of the number of reference periods comprised in the said interval of time, said first counter is an up-down counter, the output of said comparator being connected both to the down counting input of said first counter and to said motor to cause the counting down of said first counter by one unit and the backward movement of the setting member by one step in the case of equality of the signals applied at the inputs of the comparator, said first counter also having a zero position output which is connected to said device generating a warning signal when said first counter reaches the zero position, and said matrix comprises, for each position of said first counter, a different time value which is a fraction of the interval of time to be measured corresponding respectively to the steps of said setting member.

22. A timepiece as claimed in claim 19, wherein said transducer comprises a switch which is connected to said first counter for incrementing the contents thereof each time that it is actuated, said setting member comprises a series of teeth having one tooth per division of its scale, and said switch cooperates with said teeth to be actuated on the passage of each tooth.

23. A timepiece as claimed in claim 22 wherein said switch is a change-over switch with a first fixed contact connected to said accumulator circuit and a second fixed contact forming a reset contact for said accumulator circuit and which is actuated when said setting member is in its zero position.

24. A timepiece as claimed in claim 19 wherein said setting member is in the form of an annular disc.

25. A timepiece as claimed in claim 19 wherein said setting member is fitted in said timepiece like a conventional date disc.

26. A timepiece as claimed in claim 19 wherein said electromechanical timer further comprises a second setting member for control of its starting and stopping, said second setting member being associated with a switch actuated by a cam rigid with said second setting member and connected for enabling or disabling said electromechanical timer.

27. A timepiece as claimed in claim 26 wherein said second setting member is fitted like a conventional day disc of said timepiece and wherein said stem is coupled to said second setting member so as to allow adjustment thereof in said second position of said stem.

* * * * *